US006669172B1

(12) United States Patent
Bearden

(10) Patent No.: US 6,669,172 B1
(45) Date of Patent: Dec. 30, 2003

(54) POST PULLER

(76) Inventor: Paul B. Bearden, Rte. 1 Box 10B, Altoona, KS (US) 66710

( * ) Notice: Subject to any disclaimer, the term of this patent is extended or adjusted under 35 U.S.C. 154(b) by 0 days.

(21) Appl. No.: 10/349,366

(22) Filed: Jan. 22, 2003

Related U.S. Application Data

(60) Provisional application No. 60/359,941, filed on Feb. 27, 2002.

(51) Int. Cl.[7] ..... E21B 19/00
(52) U.S. Cl. ..... 254/30; 254/29 R
(58) Field of Search ..... 254/30, 31, 29 R, 254/124, 132

(56) References Cited

U.S. PATENT DOCUMENTS 672,910 A * 4/1901 Linerode ..... 188/67
2,553,077 A 5/1951 Braun
3,208,726 A 9/1965 Dowell
3,647,185 A * 3/1972 Phibbs ..... 254/30
3,823,916 A * 7/1974 Shaw ..... 254/132
3,907,253 A * 9/1975 Schosek ..... 254/29 R
4,226,402 A 10/1980 Muth
5,022,632 A 6/1991 Beideck
5,242,152 A 9/1993 Schatz
5,464,192 A 11/1995 Burnham
6,056,271 A 5/2000 Riojas

* cited by examiner

*Primary Examiner*—George Nguyen
*Assistant Examiner*—Daniel Shanley
(74) *Attorney, Agent, or Firm*—William R. Sharp

(57) ABSTRACT

A post puller is provided which is useable with a front end loader to pull a post out of the ground in a manner described herein. The post puller includes a pipe and a pair of tooth members integrally connected to the interior surface of the pipe at opposing ends thereof. The tooth members are transversely opposite one another in the pipe so as to be on opposite sides of the pipe. A mounting member is integrally connected to the exterior surface of the pipe, and a connection mechanism fixedly but removably connects the mounting member to a bucket of the front end loader to thereby fixedly mount the pipe to the bucket.

19 Claims, 2 Drawing Sheets

POST PULLER

CROSS-REFERENCE TO RELATED APPLICATIONS

This application claims the benefit of U.S. Provisional Application No. 60/359,941, filed Feb. 27, 2002.

BACKGROUND OF THE INVENTION

The invention relates to a post puller for use with a front end loader.

The conventional manner for pulling fence posts employs a front end loader having a bucket with a chain suitably attached thereto. The front end loader is typically operated in conjunction with a tractor. The operator of the tractor first moves the bucket into a position adjacent to the post to be pulled. The operator, if working alone, must then dismount from the tractor and secure the chain to the post. The operator then remounts the tractor and raises the bucket to pull the post from the ground. After lowering the bucket to place the post on the ground, the operator again dismounts from the tractor to remove the chain from the post.

The above-described series of actions are repeated for each post being pulled. This is obviously labor intensive and time consuming. Several post pulling devices have been developed for use with a front end loader or three-point hitch of a tractor. Such devices provide some improvement insofar as reducing the required time and labor, but are either too complex or prohibitively expensive to produce.

SUMMARY OF THE INVENTION

It is an object of the invention to provide a post puller useable with a front end loader which is simple and inexpensive in construction.

The above object is realized by a post puller for use with a front end loader having a bucket, comprising: a pipe having a longitudinal axis, opposing ends, an interior surface, and an exterior surface; a first tooth member integrally connected to the interior surface of the pipe at one end thereof, the first tooth member having opposing, circumferentially spaced first ends and an inner edge extending between such first ends so as to arch outwardly from the longitudinal axis of the pipe; a second tooth member integrally connected to the interior surface of the pipe at the other end thereof and transversely opposite the first tooth member, the second tooth member having opposing, circumferentially spaced second ends and an inner edge extending between such second ends so as to arch outwardly from the longitudinal axis of the pipe; a mounting member integrally connected to the exterior surface of the pipe; and connection means for fixedly but removably connecting the mounting member to the bucket to thereby fixedly mount the pipe to the bucket. Two embodiments are hereafter described which use different connection means.

According to another aspect of the invention, there is provided an apparatus comprising: a loader bucket; a pipe fixedly mounted to a side wall of the bucket; and a pair of tooth members integrally connected to the pipe and configured in the manner described above.

In use, the bucket of a front end loader is positioned to place the pipe over a post to be pulled, and the bucket is pivoted to tilt the pipe so that the tooth members engage the post. The bucket and associated pipe are raised to pull the post from the ground.

DETAILED DESCRIPTION OF THE INVENTION

In the following description and throughout this application, where a component of the post puller is described as being "integrally connected" to another component, this means that such components are fixedly connected to one another (i.e. by welding) or integral with one another. In addition, one component "fixedly connected" or "fixedly mounted" to another component is immobile with respect to such other component.

Figure 1:
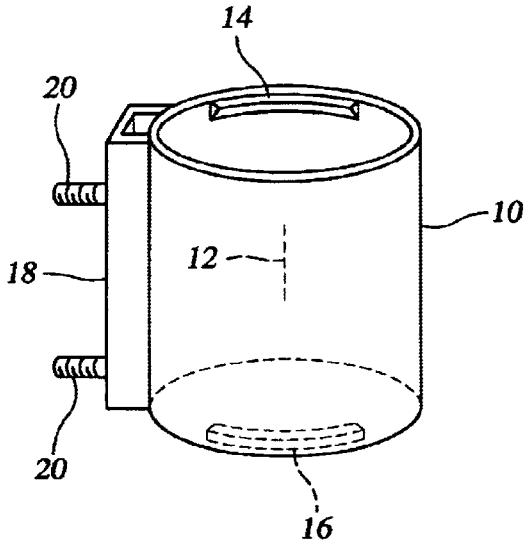
FIG. 1 is a perspective view of one embodiment in which the above-mentioned mounting member, as integrally connected to the pipe, has bolts extending therefrom.

Referring to FIG. 1, the illustrated embodiment includes a pipe 10 having a longitudinal axis 12. Pipe 10 is shown as having a circular shape, but other shapes are within the scope of the invention. Pipe 10 preferably has an inside diameter large enough (i.e. 8–10 inches) to accommodate most posts, and a wall thickness (i.e. about ⅜ inch) sufficient to withstand the considerable stress encountered during use. It is also preferred that pipe 10 is somewhat elongated. For example, a pipe having an inside diameter of 10 inches could have a length of 12 inches.

A first tooth member 14 is integrally connected to the interior surface of pipe 10 at the upper end thereof. Tooth member 14 has opposing, circumferentially spaced ends and an inner edge extending between such ends so as to arch outwardly from axis 12. A second tooth member 16 (indicated by broken lines) is integrally connected to the interior surface of pipe 10 at the lower end thereof and transversely opposite tooth member 14 so as to be on the opposite side of the pipe. Like tooth member 14, tooth member 16 also has opposing, circumferentially spaced ends and an inner edge extending between such ends so as to arch outwardly from axis 12.

In the illustrated embodiment, the inner edge of each tooth member defines a circular arc conforming to the shape of pipe 10. However, such inner edge could have some other shape which arches outwardly from axis 12, such as a "v" shape. The illustrated embodiment employs suitably curved triangle bar stock to form each of tooth members 14 and 16. Each triangle bar is preferably positioned to have its upper face substantially perpendicular to axis 12 in order to optimally grip a post. A suitable width for such upper face is about ¾ inch. Assuming a pipe inside diameter of 10 inches, each tooth member can have a suitable circumferentially measured length of about 8 inches.

A mounting member 18 is integrally connected to the exterior surface of pipe 10 so as to longitudinally extend between its upper and lower ends in intermediate relation to transversely opposed tooth members 14 and 16. Mounting member 18 is preferably comprised of channel; that is, a bar of U-shaped cross section. A suitable width for mounting member 18 is about 4 inches, and its wall thickness can be about the same as that of pipe 10. In the illustrated embodiment, a pair of longitudinally spaced bolts 20 are integrally connected to mounting member 18 so as to transversely extend therefrom.

Figure 2:
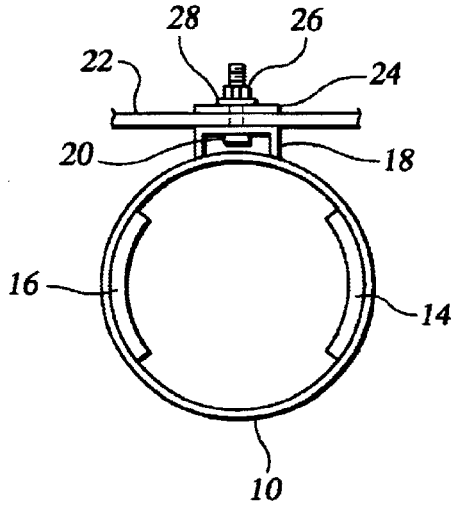
FIG. 2 is a top view of the embodiment of FIG. 1 with the mounting member fixedly but removably connected to the side wall of a bucket with nuts threadedly received on the above-mentioned bolts.

Referring to FIG. 2, this top view shows each of tooth members 14 and 16, as well as the head of the upper bolt 20 as integrally connected to mounting member 18. The lower bolt 20 is not visible in FIG. 2. Predrilled holes are provided in side wall 22 of a bucket, which is shown in its entirety in FIG. 3. Such holes are adapted to receive respective bolts 20 therethrough. A plate 24, having corresponding holes, is positioned on the side of side wall 22 opposite mounting member 18. The threaded shaft of each bolt 20 extends through aligned holes in side wall 22 and plate 24. Such aligned holes are indicated by broken lines. A nut 26 is threadedly received upon each bolt 20 and is tightened against a washer 28 to fixedly but removably connect mounting member 18 to side wall 22, thereby fixedly mounting pipe 10 to such side wall of the bucket.

Figure 3:
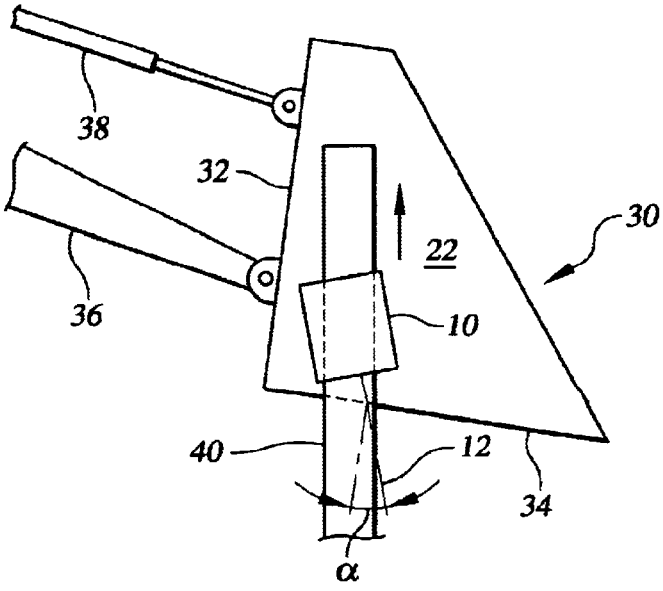
FIG. 3 is a side view of the pipe fixedly mounted to the bucket of a front end loader in use for pulling a post from the ground.

Referring to FIG. 3, this FIGURE shows a portion of a front end loader having a bucket 30. The front end loader can be operated in conjunction with a tractor (not shown). Bucket 30 has the above-mentioned side wall 22, as well as a back wall 32 and bottom wall 34. An arm 36 is pivotally connected to back wall 32, and hydraulic cylinder 38 is pivotally connected to back wall 32 above arm 36. Of course, the front end loader has a pair of arms and a pair of hydraulic cylinders, but only one arm and one hydraulic cylinder is visible in the side view of FIG. 3.

Pipe 10 is fixedly mounted to side wall 22 of bucket 30 in the manner described with reference to FIG. 2. Pipe 10 is preferably mounted to side wall 22 adjacent to back wall 32 for optimum visibility to the operator, and adjacent to bottom wall 34 for ease of use. Bottom wall 34 is substantially planar in the illustrated embodiment so as to define and lie in a plane. For reasons discussed further below, pipe 10 is also angularly oriented on bucket 30 so that the upper end of pipe 10 is positioned farther back on the bucket than the lower end. Most preferably, longitudinal axis 12 of pipe 10 defines an acute angle $\alpha$ of about 20–300° with respect to a line perpendicular to the plane of bottom wall 34.

FIG. 3 shows bucket 30 as having already been positioned to place pipe 10 over a wooden post 40 and appropriately pivoted by hydraulic cylinder 38 to tilt pipe 10 with respect to vertical, such that tooth members 14 and 16 (FIG. 2) engage and grip the post. The operator then raises bucket 30 and associated pipe 10 upward as indicated by the arrow to pull post 40 from the ground. If post 40 does not fall immediately out of pipe 10 to the ground, pivoting bucket 30 to position pipe 10 in a more vertical orientation assists in releasing the post from engagement with the tooth members. The operator can then move on to the next post for pulling in the same manner as described above. The operator can pull any number of posts in accordance with the invention using only the controls of the front end loader and without any need to dismount from the tractor. The time and labor required to pull the posts is consequently minimized.

Posts smaller than that shown require more tilt of pipe 10 with respect to vertical in order for the tooth members to engage the post, which means that hydraulic cylinder 38 must pivotally pull the bucket back to a greater extent. The angular orientation of pipe 10 on bucket 30 as discussed above allows the necessary tilt to be achieved while staying within the operational limits of the hydraulic cylinder in regard to backward pivotal movement.

To pull a steel post (not shown) having longitudinally spaced knobs, pipe 10 is tilted until both tooth members engage the post with at least one tooth member engaging the lower surface of a knob, such that upward movement of bucket 30 pulls the steel post from the ground.

Figure 4:
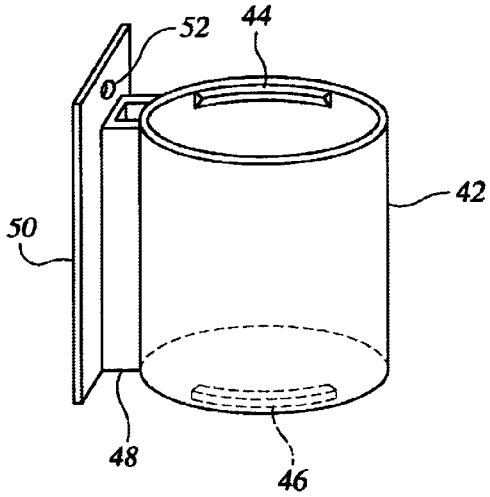
FIG. 4 is a perspective view of another embodiment showing the mounting member with a plate integrally connected thereto.

Referring to FIG. 4, the illustrated alternative embodiment is similar to the previously described embodiment in having a pipe 42, tooth members 44 and 46, and mounting member 48. However, in FIG. 4 a plate 50 is integrally connected to mounting member 48. Plate 50 extends along the length of mounting member 48 from a lower end to an upper end spaced slightly above the upper ends of pipe 42 and mounting member 48. As shown, a hole 52 is provided in plate 50 adjacent to its upper end. Plate 50 is somewhat wider than mounting member 48, such that the opposing sides of plate 50 overlap corresponding sides of mounting member 48. Assuming mounting member 48 is 4 inches wide, a suitable width for plate 50 is about 6 inches. The thickness of plate 50 can be about the same as the wall of pipe 42 (i.e. about ⅜ inch).

Figure 5:
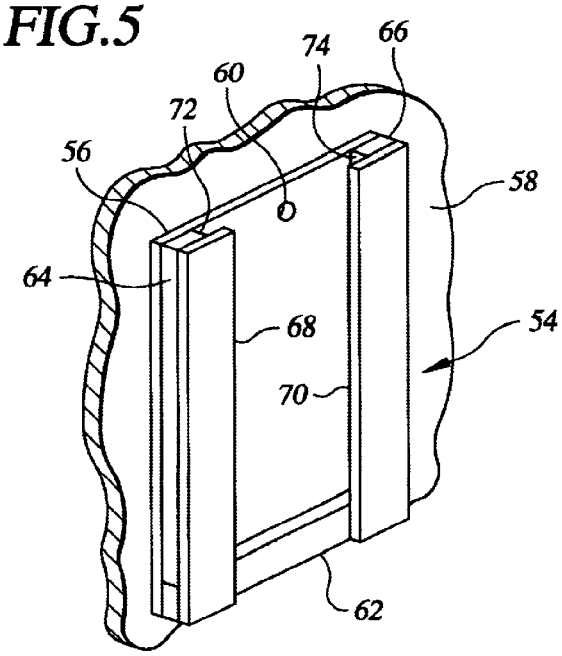
FIG. 5 is a perspective view of a receptacle frame as integrally connected to the side wall of a bucket.

Referring to FIG. 5, the illustrated receptacle frame 54 includes a plate 56 integrally connected (preferably welded) to side wall 58 of a bucket. Plate 56 has a hole 60 adjacent to its upper end. A bar 62 is integrally connected to and extends across the lower end of plate 56. Bars 64 and 66 are integrally connected to and extend along opposing sides of plate 56. Accordingly, bars 62, 64, and 66 form a "U" shape. Bars 68 and 70 are integrally connected to and extend along respective bars 64 and 66 down to bar 62, but are slightly wider (i.e. by about ½ inch) than bars 64 and 66 to thereby form transversely opposing slots 72 and 74. Receptacle frame 54 is adapted to receive plate 50 (FIG. 4) in slots 72 and 74 so that holes 52 (FIG. 4) and 60 are aligned. Bar 62 acts as a stop to plate 50. Plate 56 and bars 62, 64, 66, 68, and 70 have respective widths and lengths suitable to receive plate 50 in slots 72 and 74. The thickness of plate 56, bar 68, and bar 70 can be about the same as plate 50, whereas the thickness of bars 62, 64 and 66 should be greater than that of plate 50. Consequently, slots 72 and 74 have a depth slightly greater than the thickness of plate 50, such that plate 50 can be easily and smoothly received in the slots. For example, if plate 50 has a thickness of about ⅜ inch, each of bars 62, 64, and 66 can have a thickness of about ½ inch.

Figure 6:
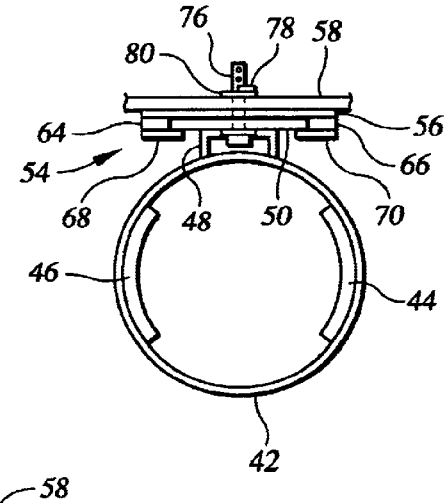
FIG. 6 is a top view of the embodiment of FIG. 4 with the mounting member fixedly but removably connected to the side wall of the bucket by means of the plate as received by the receptacle frame and an associated fastener pin.

Referring to FIG. 6, this top view shows plate 50 as received in the above-mentioned slots of receptacle frame 54. The upper ends of plate 56 and bars 62, 64, 66, 68, and 70 are shown in FIG. 6. A fastener pin 76 is received through hole 52 (FIG. 4), hole 60 (FIG. 5), and a predrilled hole in side wall 58. Such holes, as aligned with one another, are indicated in FIG. 6 by broken lines. Fastener pin 76 has several transversely extending holes adjacent to its end. A keeper pin 78 (of which only the upper end is visible) is received through one of such holes immediately adjacent to a washer 80. It should be apparent that this embodiment provides an alternative and quick means of fixedly mounting the pipe to the side wall of a bucket.

With respect to materials of construction, all components are preferably composed of steel for optimum strength and durability.

Obviously, many modifications and variations of the present invention are possible in light of the above teachings. It is, therefore, to be understood that within the scope of the appended claims the invention can be practiced otherwise than as specifically described.

What is claimed is:

1. A post puller for use with a front end loader having a bucket, comprising:

a pipe having a longitudinal axis, opposing ends, an interior surface, and an exterior surface;

a first tooth member integrally connected to the interior surface of the pipe at one end thereof, the first tooth member having opposing, circumferentially spaced first ends and an inner edge extending between such first ends so as to arch outwardly from the longitudinal axis of the pipe;

a second tooth member integrally connected to the interior surface of the pipe at the other end thereof and transversely opposite the first tooth member, the second tooth member having opposing, circumferentially spaced second ends and an inner edge extending between such second ends so as to arch outwardly from the longitudinal axis of the pipe;

a mounting member integrally connected to the exterior surface of the pipe;

and connection means for fixedly but removably connecting the mounting member to the bucket to thereby fixedly mount the pipe to the bucket.

2. A post puller as recited claim 1 wherein the inner edge of each tooth member defines an arc conforming to the shape of the pipe.

3. A post puller as recited in claim 2 wherein each tooth member comprises a bar of triangular cross section.

4. A post puller as recited in claim 1 wherein the mounting member longitudinally extends between the opposing ends of the pipe in intermediate relation to the transversely opposed first and second tooth members.

5. A post puller as recited in claim 4 wherein the mounting member comprises a bar of U-shaped cross section.

6. A post puller as recited in claim 1 wherein the connection means includes a pair of longitudinally spaced bolts integrally connected to the mounting member so as to transversely extend therefrom.

7. A post puller as recited in claim 6 wherein the connection means further includes nuts adapted to be threadedly received upon the bolts, whereby the bolts are receivable through corresponding holes in a side wall of the bucket with the nuts threadedly received upon the bolts to fixedly mount the pipe to the bucket.

8. A post puller as recited in claim 1 wherein the connection means includes a plate integrally connected to and extending along the length of the mounting member.

9. A post puller as recited in claim 1 wherein the mounting member has opposing sides integrally connected to and outwardly extending from the exterior surface of the pipe, and wherein the connection means is adapted to fixedly but removably connect the mounting member to the bucket so that the sides of the mounting member extend between the exterior surface of the pipe and the bucket.

10. An apparatus comprising:

a loader bucket having a side wall and a bottom wall;

a pipe fixedly mounted to the side wall of the bucket and having an upper end, a lower end, a longitudinal axis, an interior surface, and an exterior surface;

a first tooth member integrally connected to the interior surface of the pipe at its upper end, the first tooth member having opposing, circumferentially spaced first ends and an inner edge extending between such first ends so as to arch outwardly from the longitudinal axis of the pipe; and a second tooth member integrally connected to the interior surface of the pipe at its lower end and transversely opposite the first tooth member, the second tooth member having opposing, circumferentially spaced second ends and an inner edge extending between such second ends so as to arch outwardly from the longitudinal axis of the pipe.

11. An apparatus as recited in claim 10 wherein the bucket also has a back wall, and wherein the pipe is mounted to the side wall of the bucket adjacent to the back wall and bottom wall.

12. An apparatus as recited in claim 11 wherein the pipe is angularly oriented on the bucket so that the upper end of the pipe is positioned farther back on the bucket than the lower end.

13. An apparatus as recited in claim 12 wherein the bottom wall is substantially planar so as to define and lie in a plane, and wherein the longitudinal axis of the pipe defines an acute angle of about 20–300° with respect to a line perpendicular to the plane of the bottom wall.

14. An apparatus as recited in claim 10 wherein the bucket also has a back wall, and wherein the apparatus further comprises at least one arm and at least one hydraulic cylinder pivotally connected to the back wall.

15. An apparatus as recited in claim 10 further comprising a mounting member having opposing sides integrally connected to and outwardly extending from the exterior surface of the pipe; and connection means for fixedly but removably connecting the mounting member to the side wall of the bucket so that sides of the mounting member extend between the exterior surface of the pipe and the side wall, thereby fixedly mounting the pipe to the side wall.

16. A post puller for use with a front end loader having a bucket, comprising:

a pipe having a longitudinal axis, opposing ends, an interior surface, and an exterior surface;

a first tooth member integrally connected to the interior surface of the pipe at one end thereof, the first tooth member having opposing, circumferentially spaced first ends and an inner edge extending between such first ends so as to arch outwardly from the longitudinal axis of the pipe;

a second tooth member integrally connected to the interior surface of the pipe at the other end thereof and transversely opposite the first tooth member, the second tooth member having opposing, circumferentially spaced second ends and an inner edge extending between such second ends so as to arch outwardly from the longitudinal axis of the pipe;

a mounting member integrally connected to the exterior surface of the pipe, the mounting member having opposing sides; and connection means for fixedly but removably connecting the mounting member to the bucket to thereby fixedly mount the pipe to the bucket, wherein the connection means includes a plate integrally connected to and extending along the length of the mounting member, the plate having opposing sides and being wider than the mounting member such that the opposing sides of the plate overlap corresponding sides of the mounting member.

17. A post puller as recited in claim 16 wherein the connection means further includes a receptacle frame, having upper and lower ends, which defines a pair of transversely opposing slots adapted to receive the plate.

18. A post puller as recited in claim 17 wherein the receptacle frame has a stop means, at the lower end of the receptacle frame, for acting as a stop to the plate when such plate is received in the slots.

19. A post puller as recited in claim 18 wherein the mounting member has upper and lower ends, the plate has upper and lower ends, and the upper end of the plate is spaced above the upper end of the mounting member, and wherein the plate has a hole adjacent to its upper end and the receptacle frame has a hole adjacent to its upper end which aligns with the hole in the plate when such plate is received in the slots, the connection means further including a fastener pin which is receivable through the aligned holes in the plate and receptacle frame, whereby the receptacle frame is integrally connectable to a side wall of the bucket having a predrilled hole aligned with the hole in the receptacle frame and also the hole in the plate as received in the slots, with the fastener pin received through the aligned holes in the plate, receptacle frame, and side wall to fixedly mount the pipe to the bucket.

* * * * *